US005167458A

United States Patent [19]

Andou et al.

[11] Patent Number: 5,167,458

[45] Date of Patent: Dec. 1, 1992

[54] WIRE DRIVING MECHANISM

[75] Inventors: Hirokazu Andou; Masahiro Tatsukami; Jiro Tanuma; Hiroshi Kikuchi; Katsuya Kamimura; Tatsuya Koyama; Tatsuhiko Shimomura, all of Tokyo, Japan

[73] Assignee: Oki Electric Industry Co., Ltd., Tokyo, Japan

[21] Appl. No.: 720,435

[22] PCT Filed: Oct. 26, 1990

[86] PCT No.: PCT/JP90/01382

§ 371 Date: Jun. 27, 1991

§ 102(e) Date: Jun. 27, 1991

[87] PCT Pub. No.: WO91/06429

PCT Pub. Date: May 16, 1991

[30] Foreign Application Priority Data

Nov. 1, 1989 [JP] Japan ..... 1-127179[U]
Dec. 15, 1989 [JP] Japan ..... 1-326579
Jan. 16, 1990 [JP] Japan ..... 2-2639[U]

[51] Int. Cl.[5] ..... B41J 2/295

[52] U.S. Cl. ..... 400/124; 400/157.1

[58] Field of Search ..... 400/124, 157.1; 101/93.05

[56] References Cited

U.S. PATENT DOCUMENTS 4,435,666 3/1984 Fukui et al. ..... 310/328
4,547,086 10/1985 Matsumoto et al. ..... 400/124
4,855,633 8/1989 Shibuya ..... 400/124

FOREIGN PATENT DOCUMENTS 56-14040 2/1981 Japan .
14765 1/1983 Japan ..... 400/124
16767 1/1984 Japan ..... 400/124
56155 3/1987 Japan ..... 400/124
62-209877 9/1987 Japan .
144054 6/1988 Japan ..... 400/124
64-75256 3/1989 Japan .
1-275150 11/1989 Japan .

OTHER PUBLICATIONS

Patent Abstracts of Japan (1-275,150), 45 M 926.
Patent Abstracts of Japan (1-75,256), 117 M 842.
Patent Abstracts of Japan (62-209,877), 138 E 586.
"Magnetostrictive Actuator", IBM Technical Disclosure Bulletin, vol. 29, No. 6 (Nov. 1986) pp. 2603-2604.
IBM Technical Disclosure Bulletin, vol. 20, No. 6, Nov. 1977.

*Primary Examiner*—Clifford D. Crowder
*Assistant Examiner*—Stephen R. Funk
*Attorney, Agent, or Firm*—Spencer, Frank & Schneider

[57] ABSTRACT

A wire driving mechanism for a wire-dot print head employs a piezoelectric element or a magnetostrictive element as a driver (5). To enable printing with a satisfactorily high print quality, the wire driving mechanism employs the extensional force of the driver (5) to pivot two generally parallel levers (3*a*, 3*b*) respectively having fixed ends. When the levers (3*a*, 3*b*) are pivoted, the free end of each of the levers (3*a*, 3*b*) is moved by a displacement which is a multiple of the extension of the driver (5). The respective displacements of the free ends of the levers (3*a*, 3*b*) are transmitted by a pair of support members (6*a*, 6*b*) to opposite sides of a driving member (8) at positions on different levels with respect to the longitudinal direction of the driving member (8). As a result, the driving member (8) is moved so that a print wire (7) attached to the driving member (8) is advanced in a printing direction.

17 Claims, 10 Drawing Sheets

FIG. 5(A)
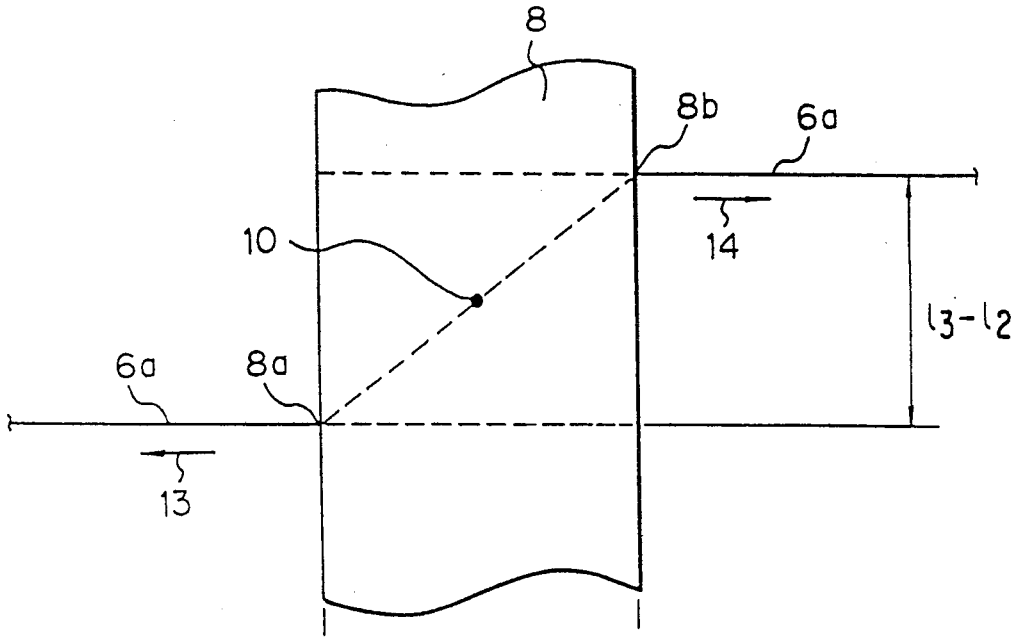
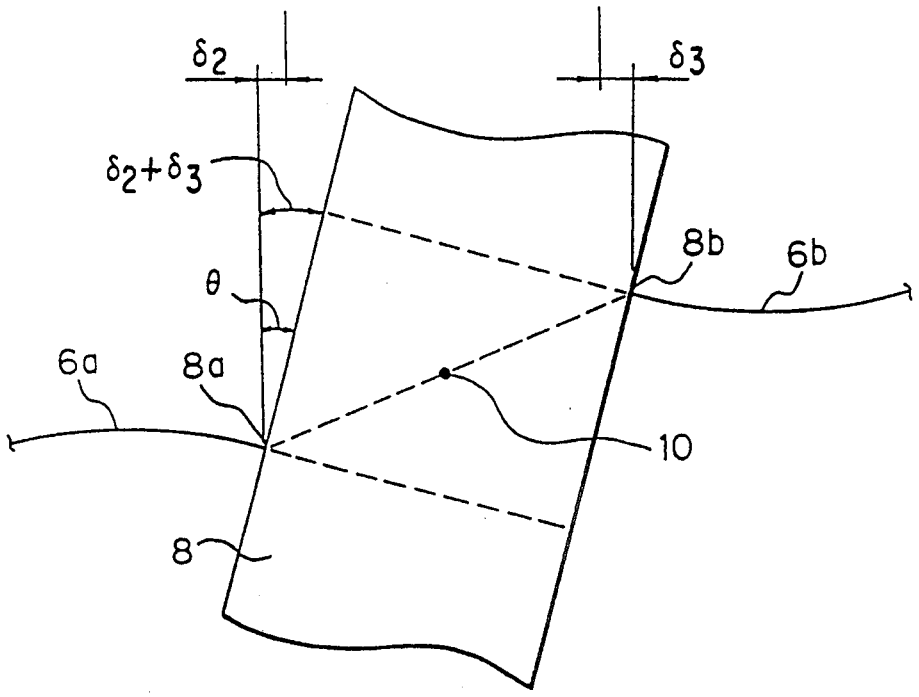
FIG. 5(B)

WIRE DRIVING MECHANISM

TECHNICAL FIELD

The present invention relates to a wire driving mechanism for driving the print wires of a wire-dot print head and, more particularly, to a wire driving mechanism employing piezoelectric elements or magnetostrictive elements as driving means.

BACKGROUND ART

A known wire-dot print head employs piezoelectric elements capable of converting electric oscillations into mechanical oscillations or magnetostrictive elements capable of being strained by a magnetic field as driving means. Since the piezoelectric action of piezoelectric elements and the magnetostrictive action of magnetostrictive elements are exactly dependent on high-frequency driving pulse signals, the employment of piezoelectric elements or magnetostrictive elements as driving means for a print head enables high-speed printing.

Although piezoelectric elements and magnetostrictive elements have the foregoing advantages, the mechanical strain of those elements, in general, is a very small value in the range of 7 μm to 15 μm, whereas the required stroke of the print wires of a print head is on the order of 0.3 mm at the minimum, and the stroke must be on the order of 0.5 mm to print on various kinds of recording media with a satisfactorily high print quality.

Print heads employing piezoelectric elements or magnetostrictive elements as driving means, such as those disclosed in Japanese Patent Laid-open (Kokai) No. 59-26273 and Japanese Utility Model Laid-open (Kokai) No. 63-198541, multiply the mechanical oscillations of the elements mechanically and transmit the multiplied mechanical oscillations to the print wires.

The known print heads proposed in Japanese Patent Laid-open (Kokai) No. 59-26273 and Japanese Utility Model Laid-open (Kokai) No. 63-198541 need a complicated mechanism, which requires much time and labor for manufacture, for mechanically multiplying dimensional variations of the elements and for transmitting the multiplied dimensional variations to the print wires. Accordingly, these known print heads have a high manufacturing cost and are difficult to manufacture by a mass-production process. The mechanical amplifying mechanism of the print head disclosed in Japanese Utility Model Laid-open No. 63-198541 has a displacement transmission system, including sliding components, which are abraded and thereby reduce the life of the print head.

Techniques for multiplying the oscillation of elements by a simple mechanism are disclosed in the following references.

A method disclosed in Japanese Patent Publication (Kokoku) No. 60-54191 em ploys a plurality of magnetostrictive elements and adds up the respective dimensional variations of the elements. A method disclosed in Japanese Patent Laid-open (Kokai) No. 63-144055 employs a horn for multiplying the oscillations of the elements.

These techniques disclosed in the foregoing two references, however, are capable of multiplying the oscillations of the elements only several times, and the multiplication ratios of these techniques are not large enough for printing with a satisfactorily high print quality.

SUMMARY OF THE INVENTION

Accordingly, it is an object of the present invention to solve the foregoing problems in the conventional print heads and to provide a simple wire driving mechanism for a print head, capable of multiplying the dimensional oscillations of piezoelectric elements or magnetostrictive elements at, a multiplication ratio large enough for printing with a satisfactorily high print quality.

It is another object of the present invention to provide a print head incorporating a sufficiently durable wire driving mechanism having high reliablility.

The present invention employs two parallel levers each having one fixed end, and turns the levers by the expansive force of extendable driving means. The extension of the extendable driving means is multiplied by the levers and the displacement of the free ends of the levers corresponds to a multiple of the extension of the extendable driving means. The respective opposite displacements of the free ends of the levers are transmitted to a driving member by a pair of support members at different positions on the driving member with respect to the longitudinal direction of the driving member, respectively, to turn the driving member. A print wire is moved through a distance necessary for printing in a printing direction by the torque of the driving member. Thus this simple mechanism is capable of multiplying the dimensional variation of the driving means at a sufficiently large multiplication ratio, to drive the print wire for a sufficiently large printing stroke for satisfactory impact printing. Thus, the wire driving mechanism provides an inexpensive print head capable of operating at a high speed at a low power consumption.

BRIEF DESCRIPTION OF THE DRAWINGS

FIGS. 5(A) and 5(B) are diagrammatic views of assistance in explaining the driving operation;

BEST MODE FOR CARRYING OUT THE INVENTION

Figure 1:
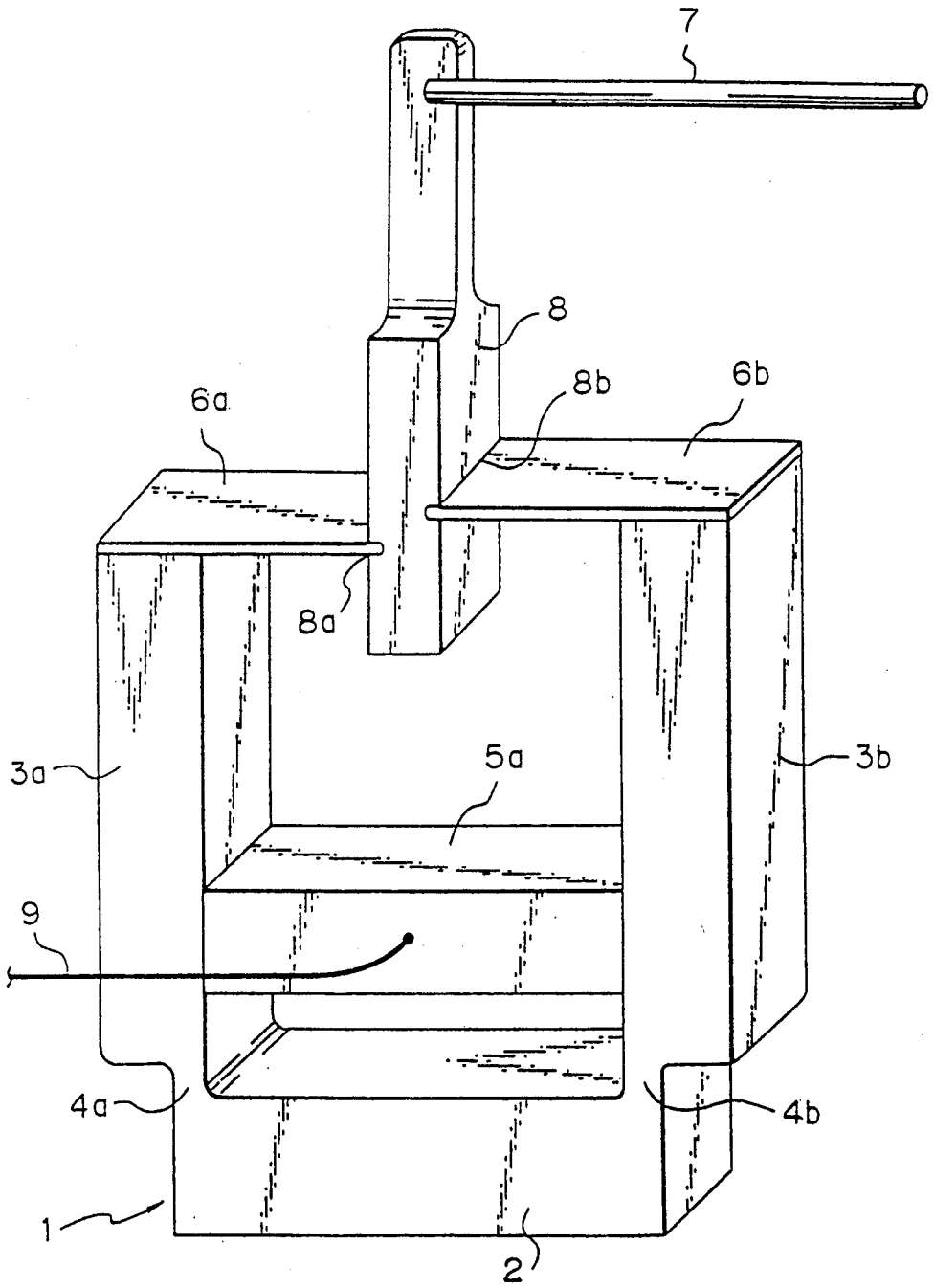
FIG. 1 is a perspective view of an essential portion of a piezoelectric wire driving mechanism.
Figure 2:
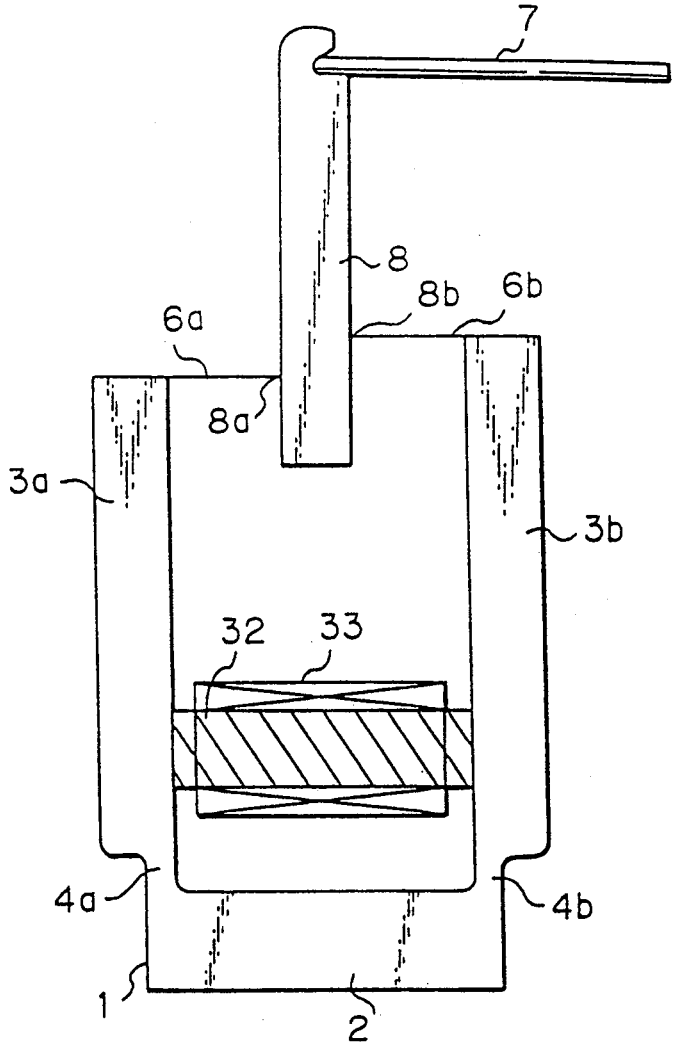
FIG. 2 is a front view of a magnetostrictive wire driving mechanism.

FIGS. 1 and 2 show a wire driving mechanism in preferred embodiments according to the present invention. FIG. 1 is a perspective view of an essential portion of a piezoelectric wire driving mechanism, and FIG. 2 is a front view of a magnetostrictive wire driving mechanism. The wire driving mechanisms shown in FIGS. 1 and 2 are identical except that the wire driving mechanism of FIG. 1 employs a piezoelectric element for driving a print wire and the wire driving mechanism of FIG. 2 employs a magnetostrictive element for driving a print wire, and hence only the piezoelectric wire driving mechanism shown in FIG. 1 will be described.

Figure 3:
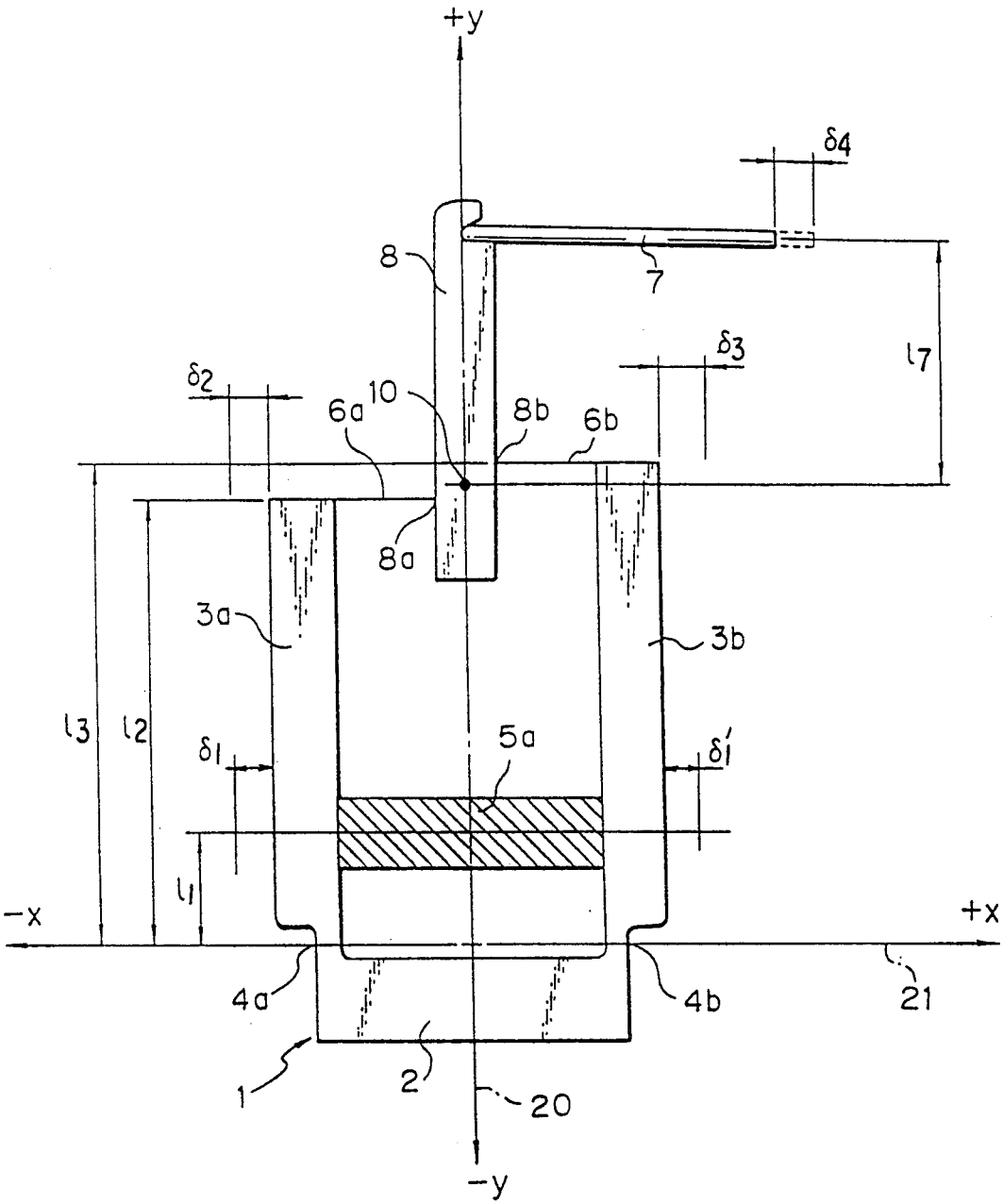
FIG. 3 is a diagrammatic view showing the dimensions of components.

Referring to FIG. 1, a wire driving mechanism in a first embodiment according to the present invention has a frame 1 consisting of a base 2, first lever 3*a* and a second lever 3*b*. The first lever 3*a* and the second lever 3*b* are extended in an upright position respectively from the opposite ends of the base 2. The frame 1 is a unitary member formed of, for example, a metal. As shown in FIG. 3, the length $l_3$ of the second lever 3*b* is greater than the length $l_2$ of the first lever 3*a*. The respective lower ends of the first lever 3*a* and the second lever 3*b* are reduced in thickness to form elastic bending portions 4*a* and 4*b* respectively at the junctions of the levers 3*a* and 3*b*, and the base 2.

A first flat spring 6*a* is attached to the upper end of the first lever 3*a*, and a second flat spring 6*b* is attached to the upper end of the second lever 3*b*. The flat springs 6*a* and 6*b* extend in parallel to the base, namely, along a direction perpendicular to the longitudinal axes of the levers 3*a* and 3*b* so that their free ends are located in the substantially middle region of the space between the levers 3*a* and 3*b* of the frame 1. Since the length $l_2$ of the first lever 3*a* is smaller than the length $l_3$ of the second lever 3*b*, the second flat spring 6*b* extends in a plane on a level above the level of a plane in which the first flat springs 6*a* extends, so that the first flat spring 6*a* and the second flat spring 6*b* are disposed in a double-level arrangement.

A driving member 8 for advancing a print wire 7 in a printing direction is supported between the free ends of the flat springs 6*a* and 6*b* at a position substantially in the middle region in the space between the levers 3*a* and 3*b* of the frame 1. The extremities of the flat springs 6*a* and 6*b* are inserted in grooves 8*a* and 8*b* formed in the opposite side surfaces of the driving member 8 at positions on different levels, respectively, to support the driving member 8 in the middle region of the space between the levers 3*a* and 3*b* of the frame 1. The center axes of the frame 1 and the driving member 8 are represented by a vertical line 20 in FIG. 3.

The wire driving mechanism employs a piezoelectric element 5*a* as driving means. The piezoelectric element 5*a* is held between the first lever 3*a* and the second lever 3*b* with its longitudinal axis in parallel to the base 2. The piezoelectric element 5*a* extends or contracts for driving action according to a voltage applied thereto through lead wires 9.

Figure 4:
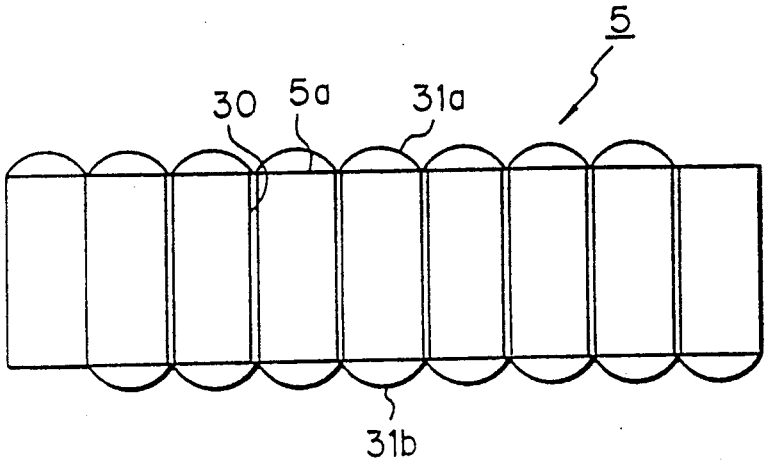
FIG. 4 is a plan view of a piezoelectric assembly consisting of a plurality of piezoelectric elements.

A piezoelectric assembly 5 as shown in FIG. 4 consisting of a plurality of piezoelectric elements 5*a* adhesively connected with an adhesive 30 and electrically connected in parallel to lead wires 31*a* and 31*b* may be employed instead of the single piezoelectric element 5*a*.

The magnetostrictive wire driving mechanism shown in FIG. 2 employs a magnetostrictive element 32 as the driving means. A coil 33 for creating a magnetic field is wound round the magnetostrictive element 32.

The operation of the wire driving mechanism thus constructed will be described hereinafter, in which circular displacements and circular motions of the components are approximated by linear displacements and linear motions, respectively, to facilitate understanding, because the angles of the circular motions are very small. In the following description, "right", "left", "upper" and "lower" in the drawings correspond respectively to "+x", "−x", "+y" and "−y", and an X-axis and a Y-axis correspond to a lateral line 21 passing the bending portions 4*a* and 4*b* and to the vertical line 20, respectively.

When a voltage is applied to the piezoelectric element 5*a*, the piezoelectric element extends in directions along the X-axis to push the first lever 3*a* in the −x-direction and to push the second lever 3*b* in the +x-direction and, consequently, the first lever 3*a* and the second lever 3*b* are turned through a very small angle at the bending portions 4*a* and 4*b* in opposite directions, namely, in the −x-direction and the +x-direction, respectively.

The relation between the extension $\delta_0$ of the piezoelectric element 5*a* and the respective displacements $\delta_1$ and $\delta_1'$ of the levers 3*a* and 3*b*, at the juctions of the levers 3*a* and 3*b* and the piezoelectric element 5*a* is expressed by:

$$\delta_1=\delta_1'=\delta_0/2 \quad (1)$$

Therefore, the displacement $\delta_2$ of the upper end of the first lever 3*a* is:

$$\delta_2=(l_2/l_1)\cdot\delta_1 \quad (2)$$

and the displacement $\delta_3$ of the upper end of the second lever 3*b* is:

$$\delta_3=(l_3/l_1)\cdot\delta_1' \quad (3)$$

The displacements of the upper ends of the levers 3*a* and 3*b* are transmitted respectively by the flat springs 6*a* and 6*b* to the driving member 8. As stated above, the flat springs 6*a* and 6*b* are attached to the upper ends of the levers 3*a* and 3*b* at the distances $l_2$ and $l_3$ from the virtual fulcrums of the levers 3*a* and 3*b*, respectively, in parallel to the X-axis. Accordingly, the grooves 8*a* and 8*b* receiving the extremities of the flat springs 6*a* and 6*b* are at distances $l_2$ and $l_3$ from the horizontal line 21, respectively. When the flat springs 6*a* and 6*b* engaging the grooves 8*a* and 8*b* of the driving member 8 are shifted through distances corresponding to the displacements $\delta_2$ and $\delta_3$ in the directions of the arrows 13 and 14 shown in FIG. 5(A), respectively, the driving member 8 is turned clockwise about an axis 10, i.e., a virtual axis of rotation, approximately through an angle $\theta$ with respect to the Y-axis as shown in FIG. 5(B), the angle $\theta$ being expressed by:

$$\theta=\sin^{-1}\{\delta_2+\delta_3/(l_3-l_2)\} \quad (4)$$

Consequently, the print wire 7 is displaced in the +x-direction by a displacement $\delta_4$, i.e., the distance between the position of the print wire indicated by continuous lines and the position of the same indicated by dotted lines in FIG. 3, expressed by:

$$\delta_4=l_7\cdot\sin\theta=\{l_7/(l_3-l_2)\}(\delta_2+\delta_3) \quad (5)$$

where $l_7$ is the distance between the axis 10 and the junction of the print wire 7 and the driving member 8.

Substituting $\delta_2=(l_2/l_1)\cdot\delta_1$, $\delta_3=(l_3/l_1)\cdot\delta_1'$ and $\delta_1=\delta_1'=\delta_0/2$ in Expression (5), $$\delta_4=\Delta l_7/2(l_3-l_2)\}\{(l_3+l_2)/l_1\}\cdot\delta_0 \quad (6)$$

Therefore, the mechanical displacement multiplication factor A, namely, the ratio of the displacement $\delta_4$ of the print wire 7 to the extention $\delta_0$ of the piezoelectric element, is expressed by:

$$A=\delta_4\delta_0=l_7(l_3+l_2)/2l_1(l_3-l_2) \quad (7)$$

Suppose that $l_1=2$ mm, $l_2=12$ mm, $l_3=13$ mm, $l_7=10$ mm. Then, substituting those values in Expression (7), $$A=10\times(13+12)/2\times2\times(13-12)=62.5$$

Thus, the extension $\delta_0$ of the piezoelectric element 5a is multiplied by the large mechanical displacement multiplication factor A of 62.5. Therefore, if the extension $\delta_0$ of the piezoelectric element 5a is 10 μm, the displacement $\delta_4$ of the print wire 7 is 10 μm×62.5=0.625 mm., which is a sufficiently large print wire displacement for a wire-dot print head.

Although in this embodiment the driving member 8 is supported by the straight flat springs 6a and 6b at ached in a double-level arrangement to levers 3a and 3b of the substantially U-shaped frame 1, the levers 3a and 3b having different lengths, it is also possible to employ a substantially U-shaped frame having levers of equal lengths, and provided with stepped flat springs attached to the levers for supporting the driving member in the same manner.

Figure 6:
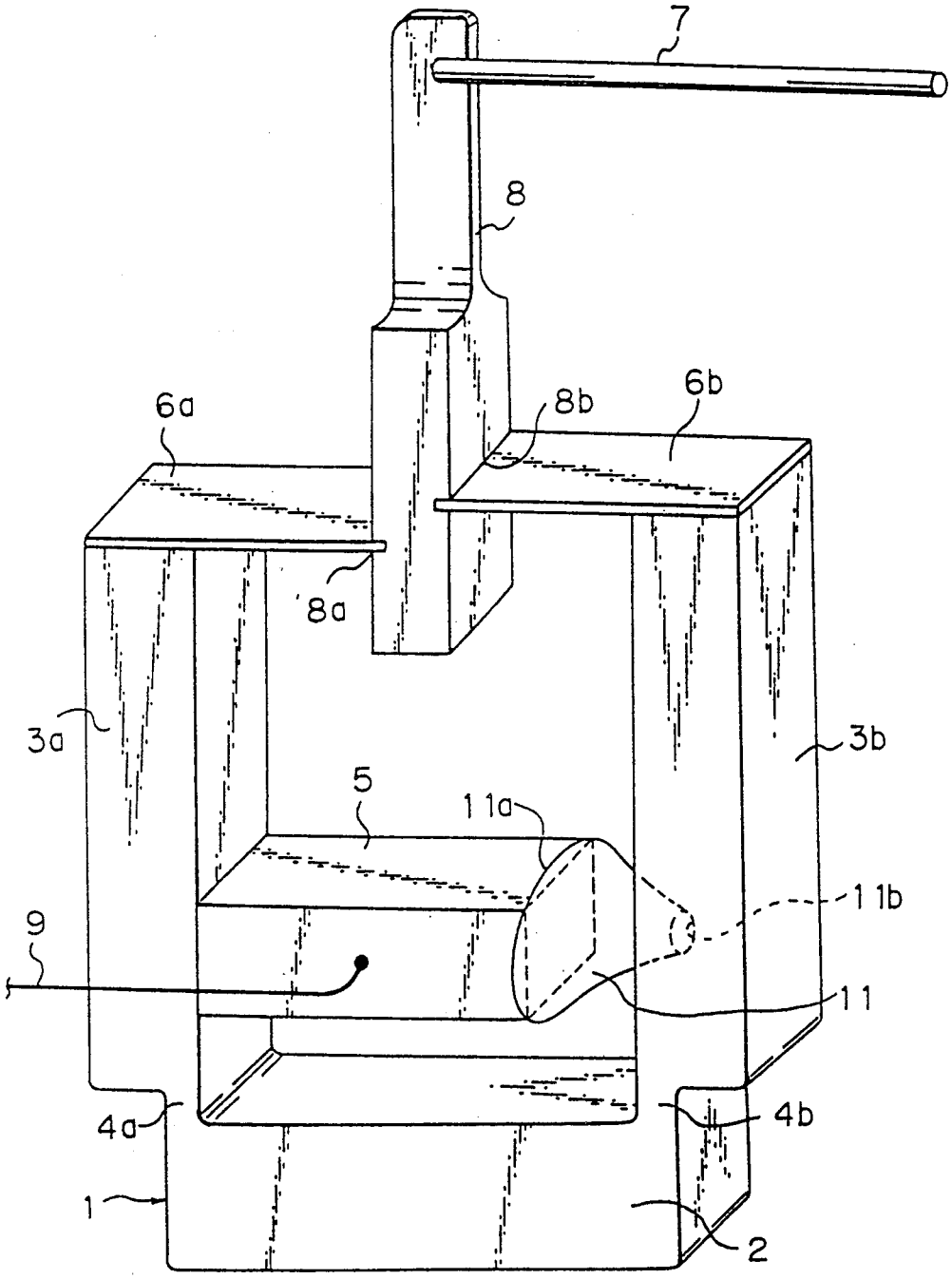
FIG. 6 is a wire driving mechanism formed by introducing a first improvement into the wire driving mechanism of FIG. 1.

FIG. 6 shows a wire driving mechanism formed by introducing a first improvement into the wire driving mechanism shown in FIG. 1, capable of further increasing the printing stroke of the print wire.

Referring to FIG. 6, the wire driving mechanism employs the piezoelectric assembly 5. A horn 11 is interposed between the piezoelectric assembly 5 and the second lever 3b. The horn 11 is a solid member formed of, for example, a metal, and has the shape of a frustum of a circular cone. The bottom surface 11a of the horn 11 is fixed firmly to the piezoelectric assembly 5 with an adhesive or the like so that the horn 11 may not be separated from the piezoelectric assembly 5 by vibrations, and the top surface 11b of the same is in contact with the second lever 3b. It will be apparent that the area of bottom surface 11a at one end of horn 11 is greater than the area of top surface 11b at the other end.

Figure 7:
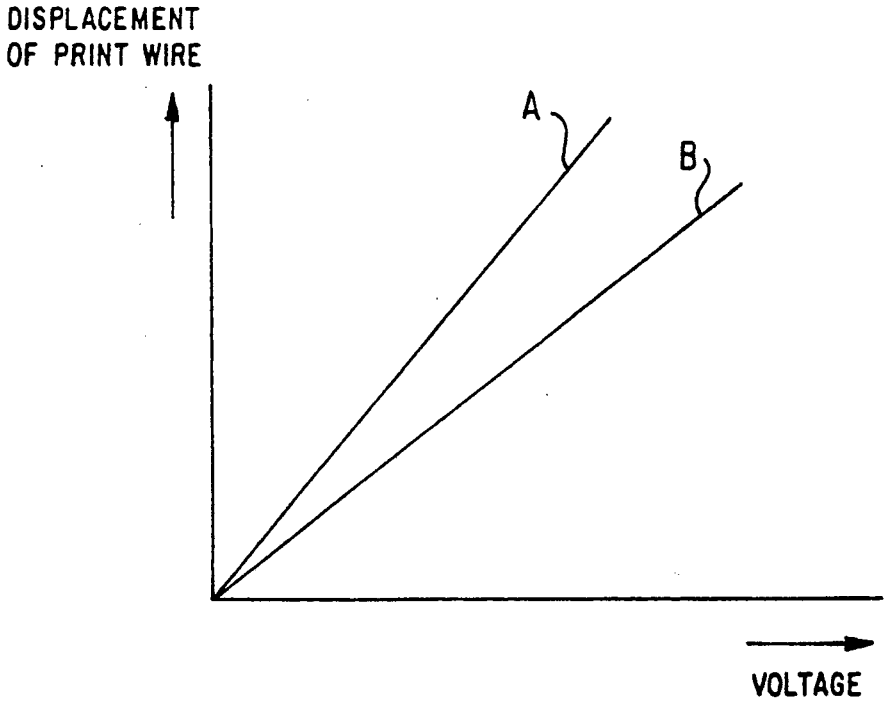
FIG. 7 is a graph showing the variation of the displacement of a wire with voltage.

The oscillatory extensions of the component piezoelectric elements are magnified by the horn 11 to apply the magnified oscillatory extensions to the levers 3a and 3b. Thus, the displacement of the print wire can be increased without increasing the piezoelectric elements or without increasing the voltage applied to the piezoelectric elements. FIG. 7 shows the variation of the displacement of the print wire with the voltage applied to the piezoelectric assembly 5, in which curve A represents print head provided with the wire driving mechanism having the horn 11, and curve B represents a print head provided with the driving mechanism of FIG. 1 not having the horn 11.

As is obvious from FIG. 7, the wire displacement of the print head having the horn 11 is greater than that of the print head not having the horn 11 for the same voltage; that is, wire driving mechanism having the horn 11 needs a voltage less than that needed by the wire driving mechanism not having the horn 11 for a fixed wire displacement.

The shape and size of the horn 11 may be varied according to the operating condition. Horns 11 of appropriate shape may be attached to both the end surfaces of the piezoelectric assembly 5 to further increase the wire displacement.

Figure 8:
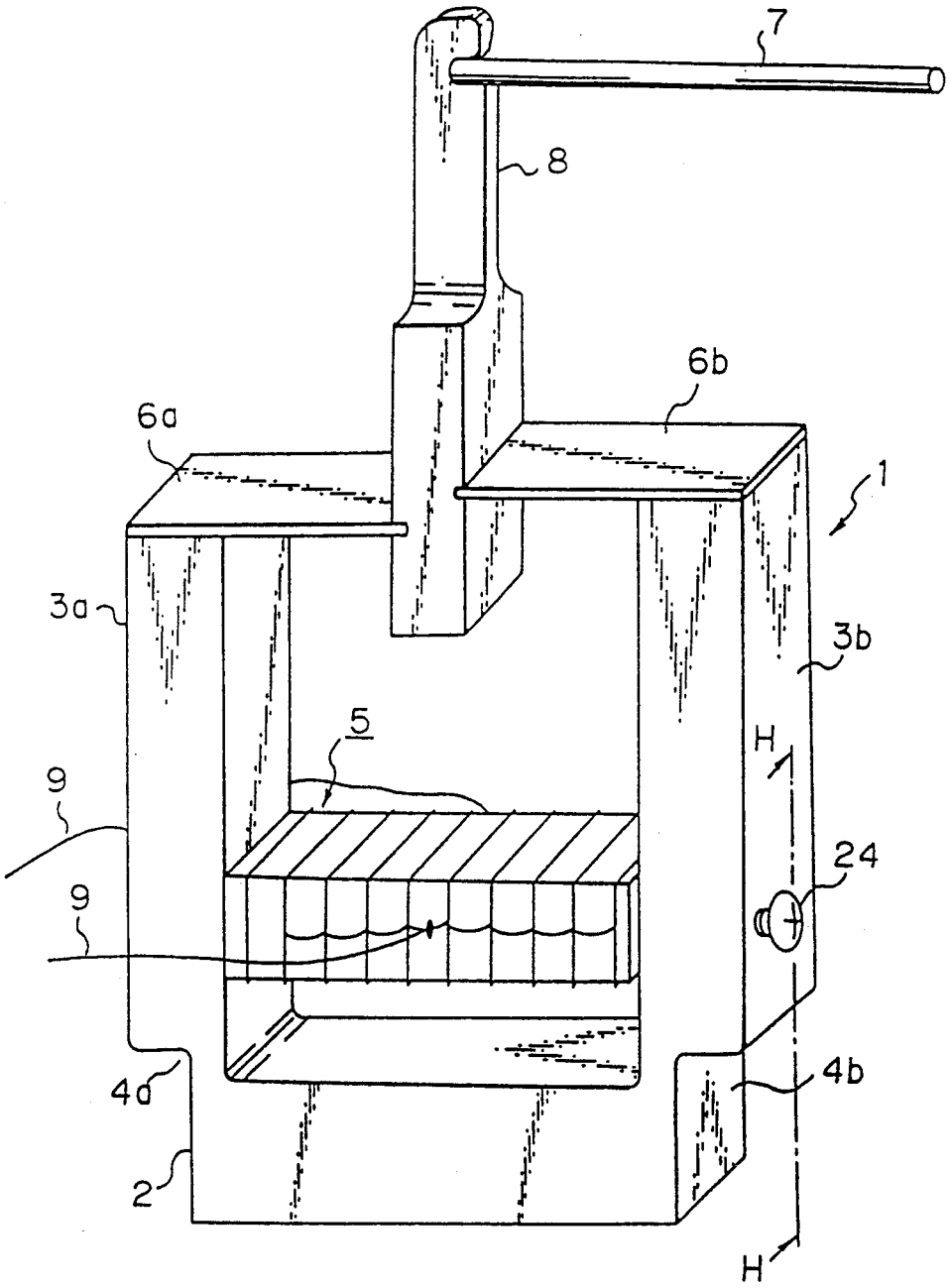
FIG. 8 ia a perspective view of a wire driving mechanism formed by introducing a second improvement into the wire driving mechanism of FIG. 1.
Figure 9:
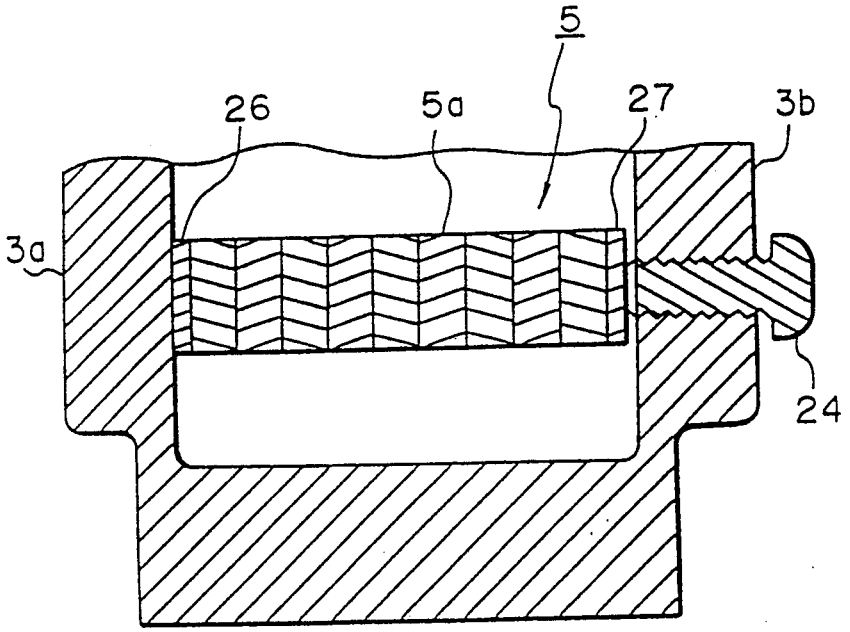
FIG. 9 is a sectional view taken on line H—H in FIG. 8.
Figure 10:
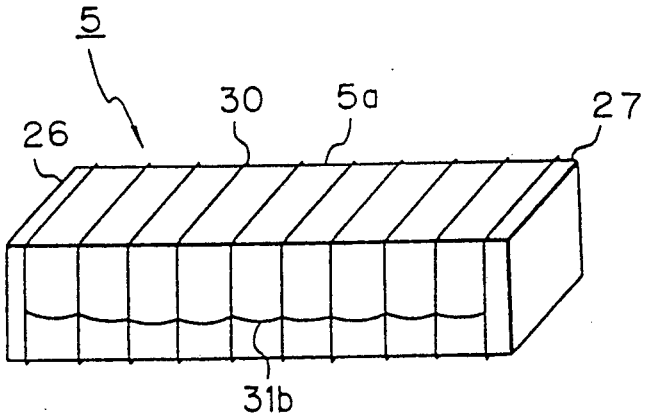
FIG. 10 is a perspective view of the piezoelectric assembly of FIG. 8.

FIGS. 8 to 10 show a wire driving mechanism formed by introducing a second improvement into the wire driving mechanism shown in FIG. 1.

FIG. 8 is a perspective view of an essential portion of a wire driving mechanism formed by introducing the second improvement into the wire driving mechanism of FIG. 1, FIG. 9 is a sectional view taken on line H—H in FIG. 8, and FIG. 10 is a perspective view of a piezoelectric assembly shown in FIG. 8. The wire driving mechanism of FIGS. 8 to 10 is different from the wire driving mechanism of FIG. 1 in that a piezoelectric assembly 5 is disposed and firmly held with a screw 24 between the first lever 3a and the second lever 3b as shown in FIGS. 8 and 9. The screw 24 is turned by a predetermined torque to compress the piezoelectric assembly 5. Metal plates 26 and 27, such as iron plates, are attached adhesively to the opposite ends of the piezoelectric assembly 5 as shown in FIG. 10.

The operation of the wire driving mechanism will be described hereinafter. When a predetermined voltage is applied to the compressed piezoelectric assembly for printing, the piezoelectric assembly 5 restores its unstrained state, bending the first lever 3a and the second lever 3b of the frame 1 at the bending portions 4a and 4b for the printing operation.

The wire driving mechanism formed by introducing the second, improvement into the wire driving mechanism of FIG. 1 utilizes the change of the state of the piezoelectric elements between a compressed state and an unstrained state. Therefore, the life of the piezoelectric elements, and hence the life of the wire driving mechanism, is extended. Furthermore the wire-dot print head incorporating the wire driving mechanism is able to operate with a high reliability, even if the piezoelectric elements have structural properties which are not favorable for extension.

Since the piezoelectric elements are held firmly between the first and second levers of the U-shaped frame with the screw, i.e., an adjustable means, the length of the piezoelectric assembly need not be controlled when forming the piezoelectric assembly by adhesively connecting a plurality of piezoelectric elements, so that an inexpensive wire-dot print head can be manufactured at a high yield.

Figure 11:
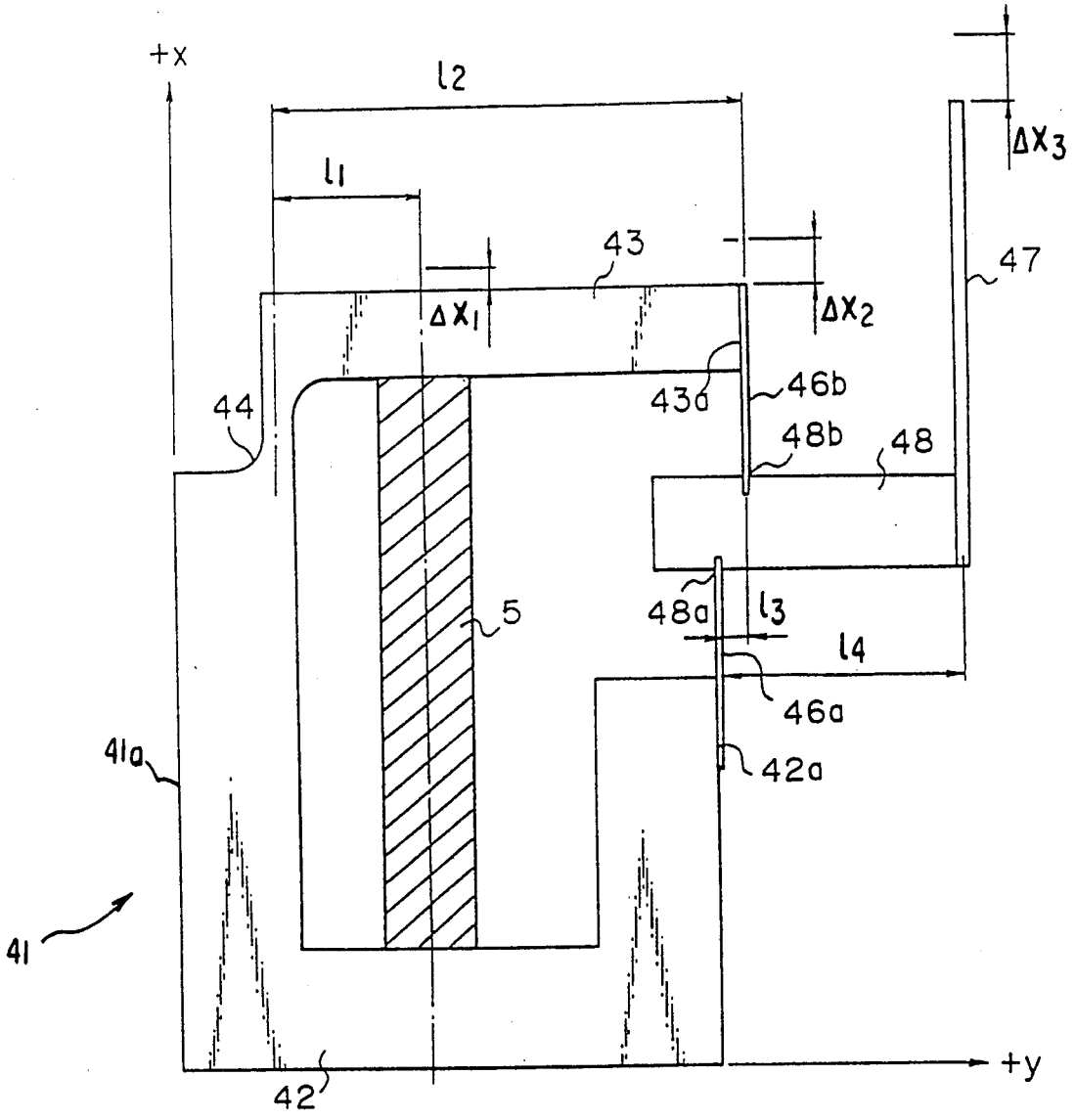
FIG. 11 is a front view of a modification of the wire driving mechanism of FIG. 1.
Figure 12:
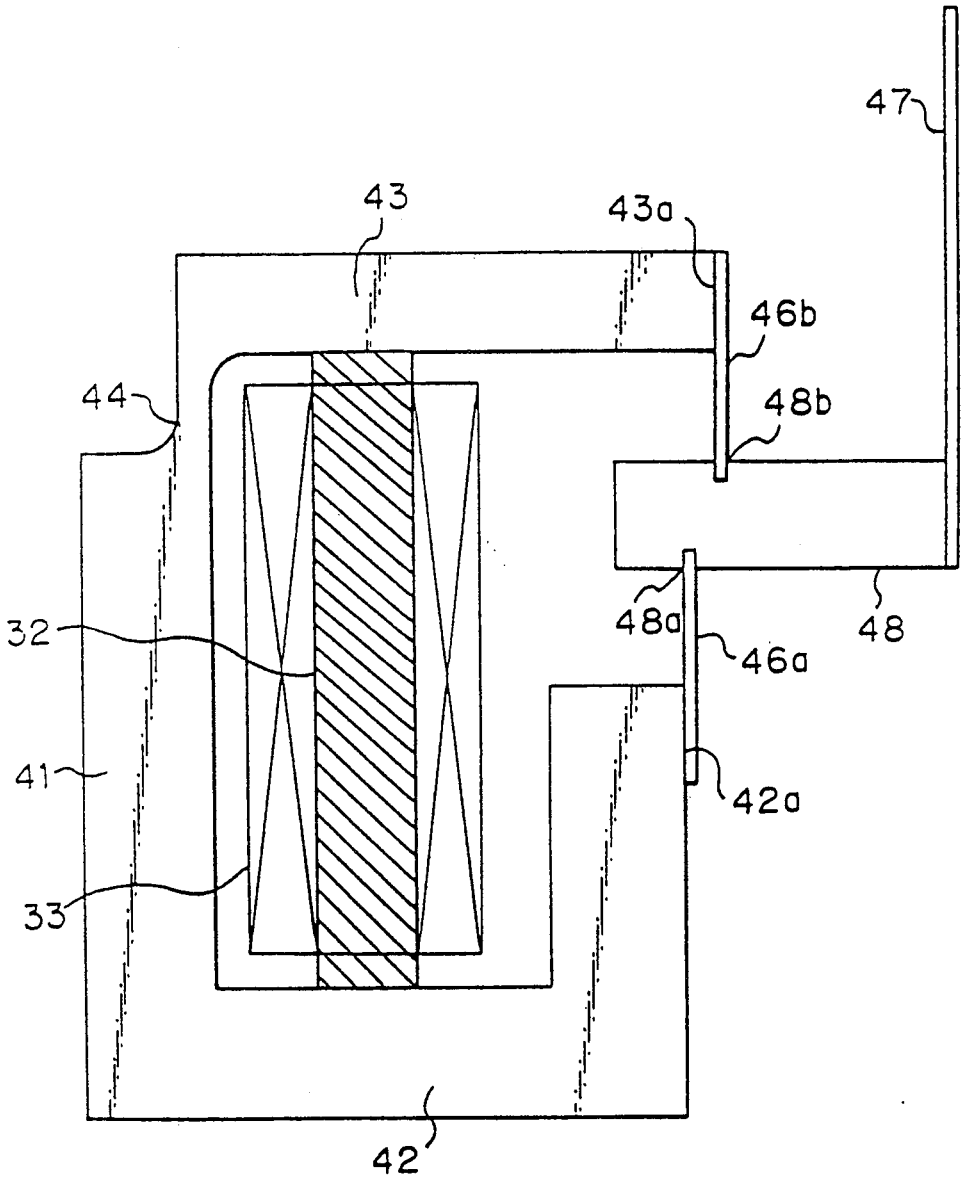
FIG. 12 is a front view of a modification of the wire driving mechanism of FIG. 2.

The driving mechanisms shown in FIGS. 11 and 12 are modifications of the wire driving mechanisms shown in FIGS. 1 and 2, respectively. Each of the wire driving mechanisms shown in FIGS. 11 and 12 employs a frame having two levers; one of the levers is swingable and the other is fixed.

The wire driving mechanism shown in FIG. 11 will be described.

A frame 41 has a back portion 41a and an L-shaped base 42 which is connected to the back portion 41a and serves as a fixed lever. A swingable lever 43 is connected to the back portion 41a by an elastic bending portion 44.

The piezoelectric assembly 5 is held fixedly between the base 42 and the lever 43.

The print head shown in FIG. 12 has a magnetostrictive element 32 fixedly held between the base 42 and the lever 43, and a coil 33 wound round the magnetostrictive element 32.

A first flat spring 46a is fixed to one end 42a of the base 42, and a second flat spring 46b is fixed to the free end 43a of the lever 43. The end 42a and the free end 43a are staggered with respect to the back portion 41a so that the first flat spring 46a and the second flat spring 46b are not aligned. The extremities of the first flat spring 46a and the second flat spring 46b engage grooves 48a and 48b formed in a driving member 48, respectively, and a print wire 47 is fixed to the driving member 48.

The operation of this embodiment will be described hereinafter.

Upon applying voltage to the piezoelectric assembly 5, the piezoelectric assembly 5 extends to push the lever 43 in the +x-direction. Consequently, the lever 43 is turned at the bending portion 44 through a very small angle. The displacement $\Delta x_1$ of a point on the lever 43 at the junction of the lever 43 and the piezoelectric assembly 5 is equal to the extension $\Delta x_0$ of the piezoelectric assembly 5, i.e., $\Delta x_1 = \Delta x_0$, and the displacement $\Delta x_2$ of the free end 43a of the lever 43 is expressed by: $\Delta x_2 = \Delta x_0 \cdot l_2 / l_1$.

The displacement $\Delta x_2$ is transmitted to the driving member 48 by the second flat spring 46b. As stated above, since the first flat spring 46a and the second flat spring 46b are disposed in a staggered arrangement and the groove 48a of the driving member 8 is connected to the base 42 and is not displaced, the driving member 48 is turned at the groove 48a through a very small angle corresponding to the displacement $\Delta x_2$.

Then, the displacement $\Delta x_3$ of the print wire 47 is expressed by:

$$\Delta x_3 = \Delta x_2 \cdot l_4 / l_3 = \Delta x_0 \cdot l_2 \cdot l_4 / l_1 \cdot l_3$$

where $l_3$ is the distance between the first flat spring 46a and the second flat spring 46b with respect to the horizontal direction, and $l_4$ is the distance between the groove 48a and the print wire 47 with respect to the horizontal direction.

Accordingly, the mechanical displacement multiplication factor of this wire driving mechanism is:

$$\Delta x_3 / \Delta x_0 = l_2 \cdot l_4 / l_1 \cdot l_3$$

Suppose that $l_1 = 2$ mm, $l_2 = 13$ mm, $l_3 = 1$ mm, $l_4 = 10.5$ mm. Then, $\Delta x_3 / \Delta x_0 = 13 \times 10.5 / 2 \times 1 = 68.25$, which is the mechanical displacement multiplication factor. If the extension $\Delta x_0$ of the piezoelectric assembly 5 is 10 $\mu$m, the displacement of the print wire 48 is 0.6825 mm.

As is apparent from the foregoing description, a wire driving mechanism in accordance with the present invention is suitable for application to the wire-dot print head of line printers and serial printers of a dot matrix type, and particularly for application to a high-speed wire dot print head.

We claim:

1. A wire driving mechanism, comprising:

parallel first and second levers, each having a free end and a fixed end and being capable of pivoting at its fixed end, the first and second levers being disposed at spaced-apart positions so that a region exists between their free ends, the region between the free ends of the first and second levers having a middle portion, the first lever being longer than the second lever;

driving means disposed between the first and second levers and capable of extending so as to pivot the first and second levers so that the free ends of the first and second levers are displaced;

a pair of support members having ends that are attached to the free ends of the first and second levers, respectively, and having other ends that are disposed in a double-level arrangement in substantially the middle portion of the region between the free ends of the first and second levers, the support members being movable in directions substantially parallel to the direction of extension of the driving means when the free ends of the first and second levers are displaced;

a driving member held between the other ends of the pair of support members at a position between the first and second levers; and a print wire attached to the driving member, the print wire being moved in directions substantially parallel to the directions of movement of the pair of support members when the driving members is turned by a force applied thereof by the support members.

2. A wire driving mechanism according to claim 1, wherein a horn for magnifying the extension of the driving means is disposed between the driving means and one of the levers, the horn having a first end with a surface and a second end with a surface that is greater in area than the surface at the first end of the horn, with the second end of the horn facing the driving means.

3. A wire driving mechanism according to claim 1, wherein said driving means comprises at least one magnetostrictive element, the extension of said driving means being variable according to the intensity of a magnetic field applied to the at least one magnetostrictive element.

4. A wire driving mechanism according to claim 1, wherein driving means comprises at least one piezoelectric element, the extension of said driving means being variable according to a voltage applied to the at least one piezoelectric element.

5. A wire driving mechanism according to claim 4, further comprising adjustable compressing means for holding the at least one piezoelectric element in place between the first and second levers and for compressing the at least one piezoelectric element.

6. A wire driving mechanism according to claim 5, wherein the at least one piezoelectric element has opposite ends, and wherein said adjustable compressing means comprises metal plates fixed to the opposite ends of the at least one piezoelectric element, and a screw provided on one of the first and second levers.

7. A wire driving mechanism, comprising:

a frame having a back portion and an L-shaped base connected to the back portion, the L-shaped base having an end located at a first predetermined distance from the back portion of the frame;

a lever having a fixed end which is connected to the back portion of the frame, the lever being spaced apart from the L-shaped base and being capable of pivoting at its fixed end, the lever additionally having a free end that is spaced apart from the back portion of the frame by a second predetermined distance, the second predetermined distance being different from the first predetermined distance;

driving means disposed between the lever and the L-shaped base and capable of extending to pivot the lever so that the free end of the lever is displaced;

a pair of support members having ends attached to the free end of the lever and to the end of the L-shaped base, respectively, and other ends disposed in a double-level arrangement between the lever and the L-shaped base, one of the support members being capable of moving in a direction substantially parallel to the direction of extension of the driving means when the free end of the lever is displaced;

a driving member held between the other ends of the pair of support members at a position between the lever and the L-shaped base;

a print wire attached to the driving member, the print wire being moved in a direction substantially parallel to the direction of movement of the free end of the lever when the driving member is turned by a force applied thereto by the support members.

8. A wire driving mechanism according to claim 7, wherein said driving means comprises at least one magnetostrictive element, the extension of the driving means being variable according to the intensity of the magnetic field applied to the at least one magnetostrictive element.

9. A wire driving mechanism according to claim 7, wherein said driving means comprises at least one piezoelectric element, the extension of the driving means being variable according to a voltage applied to the at least one piezoelectric element.

10. A wire driving mechanism, comprising:

a driving member having an end, the driving member additionally having a first side and a second side that is opposite the first side;

a print wire connected to the driving member adjacent the end of the driving member;

first and second support members, each having an inner end and an outer end, the inner end of the first support member being connected to the driving member at a position that is spaced apart from the end of the driving member by a first distance, and the inner end of the second support member being connected to the driving member at a position that is spaced apart from the end of the driving member by a second distance, the second distance being different from the first distance, the first support member extending away from the first side of the driving member and the second support member extending away from the second side of the driving member;

a lever having a fixed end, the lever being capable of pivoting at its fixed end, the outer end of the first support member being connected to the lever at a position that is spaced apart from the fixed end;

moving means for pivoting the lever, the moving means engaging the lever between its fixed end and said position that is spaced apart from the fixed end; and means for mounting the outer end of the second support member.

11. The wire driving mechanism of claim 10, wherein the means for mounting the outer end of the second support member comprises another lever having a fixed end, the another lever being capable of pivoting at its fixed end, the outer end of the second support member being connected to the another lever at a position that is spaced apart from the fixed end of the another lever, the moving means being disposed between the lever and the another lever.

12. The wire driving mechanism of claim 11, wherein the moving means engages both the lever and the another lever.

13. The wire driving mechanism of claim 11, further comprising a horn between the moving means and the another lever, the horn having a large end that engages the moving means and a small end that engages the another lever.

14. The wire driving mechanism of claim 11, further comprising adjustable compressing means for compressing the moving means, the adjustable compressing means comprising a screw which extends through the another lever.

15. The wire driving mechanism of claim 10, wherein the means for mounting the outer end of the second support member comprises a frame having a back portion and an L-shaped base connected to the back portion, the outer end of the second support member being connected to the L-shaped base, and wherein the frame additionally includes an elastic bending portion which connects the fixed end of the lever to the back portion of the frame.

16. The wire driving mechanism of claim 10, wherein the moving means comprises at least one magnetostrictive element.

17. The wire driving mechanism of claim 10, wherein the moving means comprises at least one piezoelectric element.

* * * * *